US008992391B2

(12) United States Patent
Seastrom et al.

(10) Patent No.: US 8,992,391 B2
(45) Date of Patent: Mar. 31, 2015

(54) SIZING FIT CYCLE

(75) Inventors: Robert Seastrom, Twin Falls, ID (US); Ryan Capell, Twin Falls, ID (US)

(73) Assignee: Seastrom Manufacturing Co., Inc., Twin Falls, ID (US)

( * ) Notice: Subject to any disclaimer, the term of this patent is extended or adjusted under 35 U.S.C. 154(b) by 132 days.

(21) Appl. No.: 13/449,381

(22) Filed: Apr. 18, 2012

(65) Prior Publication Data

US 2012/0202653 A1 Aug. 9, 2012

Related U.S. Application Data

(63) Continuation-in-part of application No. 13/236,564, filed on Sep. 19, 2011, now abandoned.

(60) Provisional application No. 61/384,006, filed on Sep. 17, 2010.

(51) Int. Cl.

| | |
|---|---|
| ***A63B 22/06*** | (2006.01) |
| ***A63B 22/14*** | (2006.01) |
| ***A63B 71/06*** | (2006.01) |
| ***A63B 21/22*** | (2006.01) |
| *A63B 24/00* | (2006.01) |

(52) U.S. Cl.

CPC ..... *A63B 22/0605* (2013.01); *A63B 71/0622* (2013.01); *A63B 21/225* (2013.01); *A63B 24/0062* (2013.01); *A63B 24/0075* (2013.01); *A63B 2022/0658* (2013.01); *A63B 2071/0658* (2013.01); *A63B 2220/17* (2013.01); *A63B 2220/30* (2013.01); *A63B 2220/70* (2013.01); *A63B 2225/09* (2013.01); *A63B 2225/20* (2013.01); *A63B 2230/06* (2013.01)

USPC ..... 482/57; 482/61; 482/51

(58) Field of Classification Search

CPC ..... A63B 2225/09; A63B 2225/096; A63B 22/00; A63B 22/0015; A63B 22/046; A63B 22/0087; A63B 22/06; A63B 22/08; A63B 69/00; A63B 69/16

USPC ..... 482/57, 61

See application file for complete search history.

(56) References Cited

U.S. PATENT DOCUMENTS

| | | | | |
|---|---|---|---|---|
| 600,408 | A * | 3/1898 | Crowden | 33/655 |
| 4,889,335 | A * | 12/1989 | Chen | 482/59 |
| 6,926,648 | B2 * | 8/2005 | Capizzo | 482/104 |
| 7,575,538 | B1 * | 8/2009 | Clark | 482/103 |
| 7,752,767 | B2 * | 7/2010 | Mandaric | 33/512 |
| 7,878,951 | B2 * | 2/2011 | Roman et al. | 482/72 |
| 7,905,817 | B2 * | 3/2011 | Giannascoli et al. | 482/57 |

* cited by examiner

*Primary Examiner* — Loan H Thanh
*Assistant Examiner* — Rae Fischer
(74) *Attorney, Agent, or Firm* — Michael L. Greenberg, Esq.; Greenberg & Lieberman, LLC

(57) ABSTRACT

A modular sizing fit cycle, having an enclosed, acoustically dampened transmission, and calibrated height and angle adjusters, each designed to fit an individual to a bicycle according to specific measurements attained during a controlled ride. The sizing fit cycle is highly portable, having distinct pieces that facilitate portability. Additionally, the sizing fit cycle is preferably equipped with a quiet, chain and bell-driven transmission at the rear, facilitating accurate measurements via a load generator and providing a realistic simulation of a stable cycling session.

5 Claims, 3 Drawing Sheets

SIZING FIT CYCLE

CONTINUITY DATA

This is a continuation-in-part application of utility application Ser. No. 13/236,564 filed on Sep. 19, 2011 now abandoned, (and priority is claimed thereto), which is a non-provisional application of provisional application No. 61/384,006, filed on Sep. 17, 2010.

FIELD OF THE PRESENT INVENTION

The present invention relates to a stationary cycle and, more specifically, to a sizing fit cycle that is portable, sturdy, highly adjustable, and equipped with a quiet, belt and chain driven transmission designed to vary the level of the resistance, and monitor the resulting stress via a computer.

BACKGROUND OF THE PRESENT INVENTION

While bicycling technology has continued to advance, making it easier to find a sturdy bike that is well suited for an individual, the most astute cyclists will continue to desire a custom bicycle setup to maximize their speed and comfort. Custom bicycle setups offer added comfort to the rider, and their personalized, optimized spacing is designed to achieve the most thrust from a user's pedaling. In theory, a custom bicycle setup should be the best bike an individual has ever been on.

A sizing fit cycle is a well known item in the bicycle industry, and is required to properly fit an individual to a bicycle frame and assembly. It is commonly used to fit individuals to a particular bicycle, or to assist in building a custom bicycle for an individual. Unfortunately, conventional sizing fit cycles are cumbersome, large, and non-portable—often taking up large portions of space in bicycle shops. They also frequently employ a large chain driven wheel.

A conventional sizing fit cycle suffers from several disadvantages. First, the size of a conventional sizing fit cycle is fairly large, and therefore, the portability of the cycle is low. The size is partially determined by the size of the traditional bicycle tire that frequently accompanies the resistant device. A conventional bicycle tire is 26-29 inches in diameter, and the tire often requires additional space in order to spin freely without causing injury or damage. This bicycle tire is often an open wheel that poses a danger in which an individual may be caught in the wheel spokes while it is spinning during the sizing process. The conventional fit cycle is not modular, making it fairly impractical for travel, mobile fitting vehicles, or shipping by a common mail carrier.

Furthermore, the conventional sizing fit cycle employs a chain driven system to rotate the open wheel bicycle tire, which, when improperly guarded, may be an additional hazardous area. An individual may be caught by the fast-spinning chain, as the individual is close to the spinning chain during the extent of the bicycle sizing process. This chain-driven system employs sprockets to turn gears via the chain. These sprockets are generally exposed to all persons, and if not guarded, can be a severe pinch point. A digit or article of clothing could become lodged between the chain and the sprocket, causing a serious accident or loss of said digit. During the bicycle sizing process, the individual performing the sizing is proximal to these hazardous spinning gears on a conventional sizing fit cycle.

Additionally, this chain-driven system requires semi-frequent lubrication, which is often greasy and messy. Without adequate guarding, or if excess lubricant is used, grease could damage clothing that comes in contact with the sizing fit cycle, which could be a potential customer or the individual operating the conventional sizing fit cycle. The chain-driven system requires maintenance as well, including the lubrication, storage, and transportation of the lubricants and maintenance materials required to keep the conventional sizing fit cycle in operational condition. The chain requires timely, proper lubrication in order for the sizing fit cycle to function properly.

Conversely, the manner by which a conventional sizing cycle is used is fairly inefficient as well. The process by which adjustments are made to height of the user, height of the handlebars, and width spacing of the wheels, on a conventional sizing fit cycle is often laborious and cumbersome as well. To make the necessary adjustments to determine the proper size of bicycle that a person needs, the conventional sizing fit cycle employs a manual, electric, or hydraulic power adjusters, each with their own set of drawbacks. The hydraulic power system requires electricity to function and may be susceptible to leaking and over pressurization, which may cause damage to clothing, carpeting or flooring. A manual adjustment process requires excessive strength by the fitter, and fine adjustments to spacing are often difficult. Furthermore, the individual being sized must get off of the sizing fit cycle in order for adjustments to be made. This process of mounting and dismounting the sizing fit cycle for each adjustment increase the time to complete the task of fitting a person to a bicycle unnecessarily. Additionally, the electrically powered adjustment system requires a constant source of electricity, which is often accompanied by electric extension cables. These electric cables are potential trip hazards. Similarly, employing electricity increases the overall cost of fitting an individual to a bicycle as well. Electric models do not lend well to mobile fitting either, as they are inoperable without electricity.

A conventional sizing fit cycle commonly lacks any leveling indicators as well, making it difficult to determine if the sizing fit cycle is on level ground. A sizing fit cycle must be level in order to do a proper fitting. The absence of a level indicator requires the person doing the fitting (the fitter) to assume it is level, or to employ another tool to determine if the sizing cycle is level with the ground.

Likewise, a conventional sizing fit cycle generally only allows for the use of one type of resistance device to create or simulate torque for the individual on the cycle, in order to acquire a proper fit. Also, conventional sizing fit cycles lack sturdiness and rigidity, often causing individuals to be apprehensive to using a sizing fit cycle when purchasing a bicycle. A sizing fit cycle should be sturdy and rigid such that the person on the sizing fit cycle maintains the confidence to ride naturally and not feel he or she may fall, improving the fitting process. If there were a way to ensure the stability of a sizing fit bicycle, while making it more comfortable and safer to the user, the sizing process would be employed more often by potential customers, and more individuals would likely purchase custom bicycles.

Thus, there is a need for a redesigned sizing fit cycle that is designed to be highly portable, modular, and quiet. It should preferably eliminate the large cumbersome bicycle tire found on the rear of most conventional sizing fit cycles, ensuring a safer, sturdier sizing experience and better repeatability. Conventional sizing fit cycles often produce inconsistent results due to variances in the air pressure of the bicycle tire, as well as the variance on the pressure of the resistor-mechanism. Preferably, this redesigned sizing fit cycle employs an adjustment system that functions according to the X and the Y axis of a bicycle, and is powered such that an individual is not required to dismount the sizing fit cycle when adjustments are made.

U.S. Pat. No. 7,905,817, granted to Giannascoli et al Aug. 28, 2007 is for an Adjustable Stationary Bicycle. Giannascoli's invention employs a wheel rather than a quiet transmission. Additionally, the present invention is more portable, having separate sections designed for mobility. Giannascoli's device is not outfitted with a leveling device, whereas the present invention employs a system of level gauges and leveling feet to ensure the base remains level. Additionally, Giannascoli's device relies heavily on a computer, whereas the present invention does not.

SUMMARY OF THE PRESENT INVENTION

The present invention, a modular sizing fit cycle, is a stable, stationary cycle equipped with a chain and belt driven transmission in place of a rear physical bicycle wheel. The transmission is preferably small enough such that the present invention remains highly portable. Therefore, this transmission is approximately $1/6^{th}$ the size of a typical bicycle tire employed in a conventional sizing fit cycle. The chain and belt-driven transmission of the present invention is preferably enclosed in order to eliminate several of the dangers and disadvantages that are consistent with the conventional chain-driven system. There is preferably only one external pulley on the present invention. Thus, there is no open spinning wheel, nor chains or exposed gears. Additionally, there is preferably no need for additional lubrication, as the present invention primarily employs belts rather than chains. One chain is preferably used however, which may be lubricated with grease via an incorporated lubrication insert.

The present invention is designed to be portable. Therefore, it employs a structure that is smaller and modular in comparison to conventional sizing fit cycle models. The present invention is preferably segmented in sections, each of which may be easily packed for travel, and later reassembled on location. The preferred embodiment of the present invention may be separated into eight separate sections for easy transport.

In keeping with conventional bicycle gear ratios and resistance measurements, the belt/chain-driven transmission employed by the present invention is geared to identically match a full size tire. This replication is made possible via a load generator. Generally, a shifting mechanism is preferably installed onto the present invention, within the transmission, to make the person on the sizing fit cycle feel like he or she is riding a full size bicycle.

The present invention employs screw-like lifts to perform horizontal and vertical adjustments to the seat and handlebars locations, as well as to adjust the space found between the two tires. These screw-like lifts ensure that the sizing fit process is faster and more economical. Furthermore, these screws enable much more accurate adjustments to be made easily and with more precision. Additionally, these screws require less care and maintenance than the conventional hydraulic lifts, and are generally much cleaner. Additionally, no electrical power is required, therefore eliminating electrical power access issues. These fine adjustments are preferably enhanced via several measuring points found on the horizontal and vertical axis, helping to quantitate the adjustments.

Given that the present invention functions on a horizontal and a vertical axis, it is much easier and quicker to determine the X/Y plane of space. In the preferred embodiment of the present invention, adjustments to the tire spacing, handlebars height, and seat height, are made via their corresponding horizontal or vertical axes, rather than the typical sizing fit cycle adjustment calibration, which often employs angles, quantitated by degrees. The present invention assists with the rapid determination of the X/Y plane of space, making adjustments easier and faster, correlating to a more precise and expedient fitting process.

Additionally, a computer stand is attached to the front of cycle for the placement of a small laptop or netbook computer. This laptop could be hooked up to the resistance device for additional analysis, or used to record the various measurements acquired during the fitting process. This is generally to be used by the individual performing the sizing, not the individual riding the sizing fit cycle—however, the computer stand is designed such that it may be reversed. With the computer reversed, it is envisioned that the present invention may be used independently of a dedicated 'sizer', or rather, an individual available to work the computer and aide with the bicycle sizing.

The transmission of the present invention is critical to the quiet and efficient function of the present invention. The transmission enables the system to be quiet enough for comfortable use indoors, preferably 66 to 72 dB. The transmission is designed to simulate the feeling of riding a real bicycle, and has been designed with safety as a key issue as well.

BRIEF DESCRIPTION OF THE DRAWINGS

Reference is made to the attached drawings, wherein elements having the same reference numeral designations represent like elements throughout and wherein.

DETAILED DESCRIPTION OF THE PREFERRED EMBODIMENT

Figure 1:
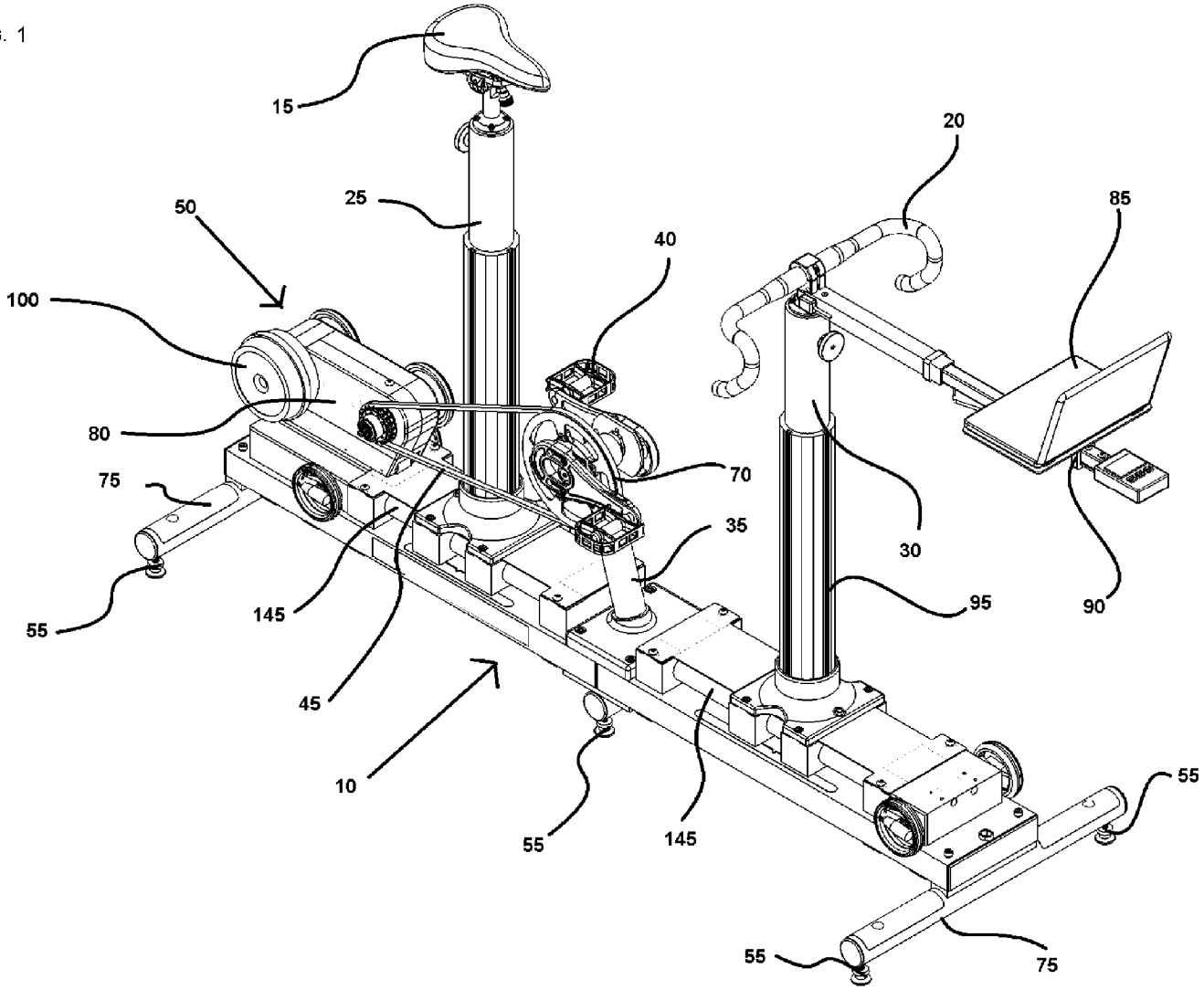
FIG. 1 displays the present invention as a whole, from the side.

The present invention, a modular sizing fit cycle is equipped with a horizontal, adjustable base (10), a seat (15), and a set of handlebars (20), configured to determine the ideal sizing dimensions of a bicycle for a specific individual. The present invention attains the X and Y measurements of the ideal sizing data and records the data via a computer (85), preferably connected to the present invention, which is designed to monitor speed, wattage, cadence, heart rate, and other data generated by an individual while riding the sizing fit cycle via a load generator, referred to as a resistance device (100). The resistance device (100) is preferably incorporated into the transmission (50) of the present invention, and conveys data to the computer (85) based on the resistance established, which displays the data to an individual via a monitor or printout.

The preferred embodiment of the present invention is configured with a horizontal base (10), which is supported by at least two stabilizers (75), designed to keep the present invention stable, even when in use—namely being ridden by an individual. The base (10) is kept level through the aide of leveling screws (55), each found preferably at the edge of each of the stabilizers (75). The leveling screws (55) are used in conjunction with an integrated level, designed to facilitate the setup of the present invention at any location. The leveling screws (55) can be rotated in order to finely adjust the level of the present invention.

The base (10) provides a secure, stable location to mount a stationary bicycle setup to. The present invention preferably employs a rail system on the base (10), designed to provide an easy position to mount elements of the invention for use. At one end of the rail mounting system on the base (10), the transmission (50) of the present invention is affixed. Its location is preferably adjustable via an adjustment knob. The transmission is designed to be self-sustaining, given that the primary gears employed are safely kept enclosed within the casing of the transmission. This casing helps to ensure that the present invention remains relatively quiet when in use, which helps encourage individuals to use it. The transmission takes the place of the rear free-spinning wheel found on most conventional sizing fit cycles, ensuring minimal space is required for the present invention to function, as well as ensuring that maximum portability is retained.

Additionally mounted to the base (10) exists a telescoping seat mount (25). The telescoping seat mount (25) is designed such that it is easy to vary the height of the rider and angle of the seat, even while the rider is still on the present invention. It is mounted securely to the base (10) via the rail mounting system, just in front of the transmission. It is designed to be comfortable to the rider, while remaining stable during use. The seat height is calibrated on the telescoping cylinder comprising the telescoping seat mount (25). This calibration data is preferably in metric and is unique to each rider. The data is used by the computer (85), along with other data, to determine the ideal bicycle dimensions for a given individual.

In conjunction with the telescoping seat mount (25), known as a first lift, the present invention is equipped with a telescoping handlebar mount (30), known as a second lift, as well. The telescoping handlebar mount (30) is designed to hold the handlebars (20) at a desired height and angle while an individual rides the present invention, and is sized for a custom bicycle. As with the telescoping seat mount (25), the telescoping handlebar mount (30) is calibrated such that the operator sizing the individual is able to take note of the ideal handlebar (20) height and angle for the rider. This data, along with the ideal seat height and angle, as well as the ideal distance between the handlebars and the seat, is entered into the accompanying computer (85), and helps to construct the individual's ideal bicycle size. It is to be understood that the telescoping seat mount is known as the first lift and the telescoping handlebar mount is known as the second lift.

Both the telescoping handlebar mount (30) and the telescoping seat mount (25) are mounted securely to the base (10) on the rail, as seen in FIG. 1. The rail is designed such that elements mounted to the rail may be moved horizontally, providing further adjustment for riders. Therefore, an individual sizing another individual on the present invention could vary the distance between the seat (15) and the handlebars (20) by moving the telescoping handlebar mount (30) horizontally along the base (10). This is preferably calibrated as well, such that the ideal spacing measurement may be recorded easily to the computer (85) after it is attained. It is envisioned that the base (10) of the present invention is to be equipped with more than one rail, such that the telescoping seat mount (25) and the telescoping handlebar mount (30) may be affixed to distinctly different rails located on the base (10), as seen in FIG. 1. Via these rails, both the telescoping seat mount (25) and the telescoping handlebar mount (30) may be moved laterally along the horizontal rails (145) found on the base (10), enabling users to customize the distance between the handlebars and the seat of their custom bicycle setup.

Additionally, the pedals (40) can be found mounted to the base (10) which, along with the primary sprocket (70), composes the remainder of the drivetrain of the present invention. The pedals (40) are located on pedal crank arms which are also adjustable in order to best fit the rider. An individual need not dismount the present invention in order to adjust the pedal crank arms. Rather than employing a conventional bicycle chain, the present invention makes use of a system of rubber belts. The primary drive chain (45) connects the pedals (40) to the transmission (50). The transmission (50) houses the remainder of the rubber belts and the load generator, which function together to provide a variety of resistance levels to the user when riding. This creates the simulation of an actual bicycle ride, despite the fact that the present invention is designed to remain stationary while collecting sizing data. A load generator (100) is stored within the transmission (50), functioning to vary the transmission resistance in accordance with commands from the computer (85). The load generator (100) also records statistics of the ride including speed, wattage, resistance, distance, and other factors. The pedals (40) are mounted to a center support pole (35).

Figure 2:
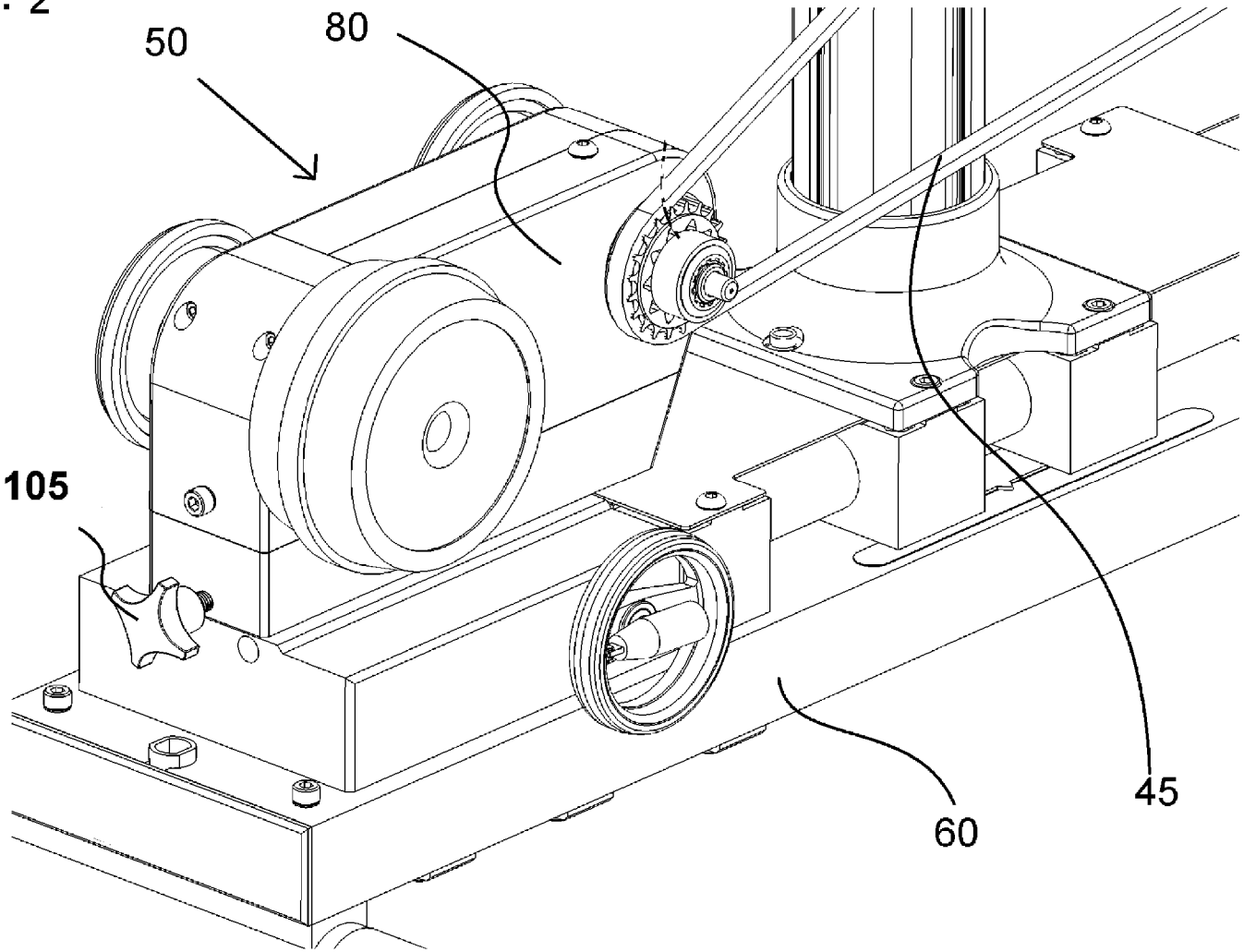
FIG. 2 highlights the rear of the present invention, specifically the transmission.
Figure 3:
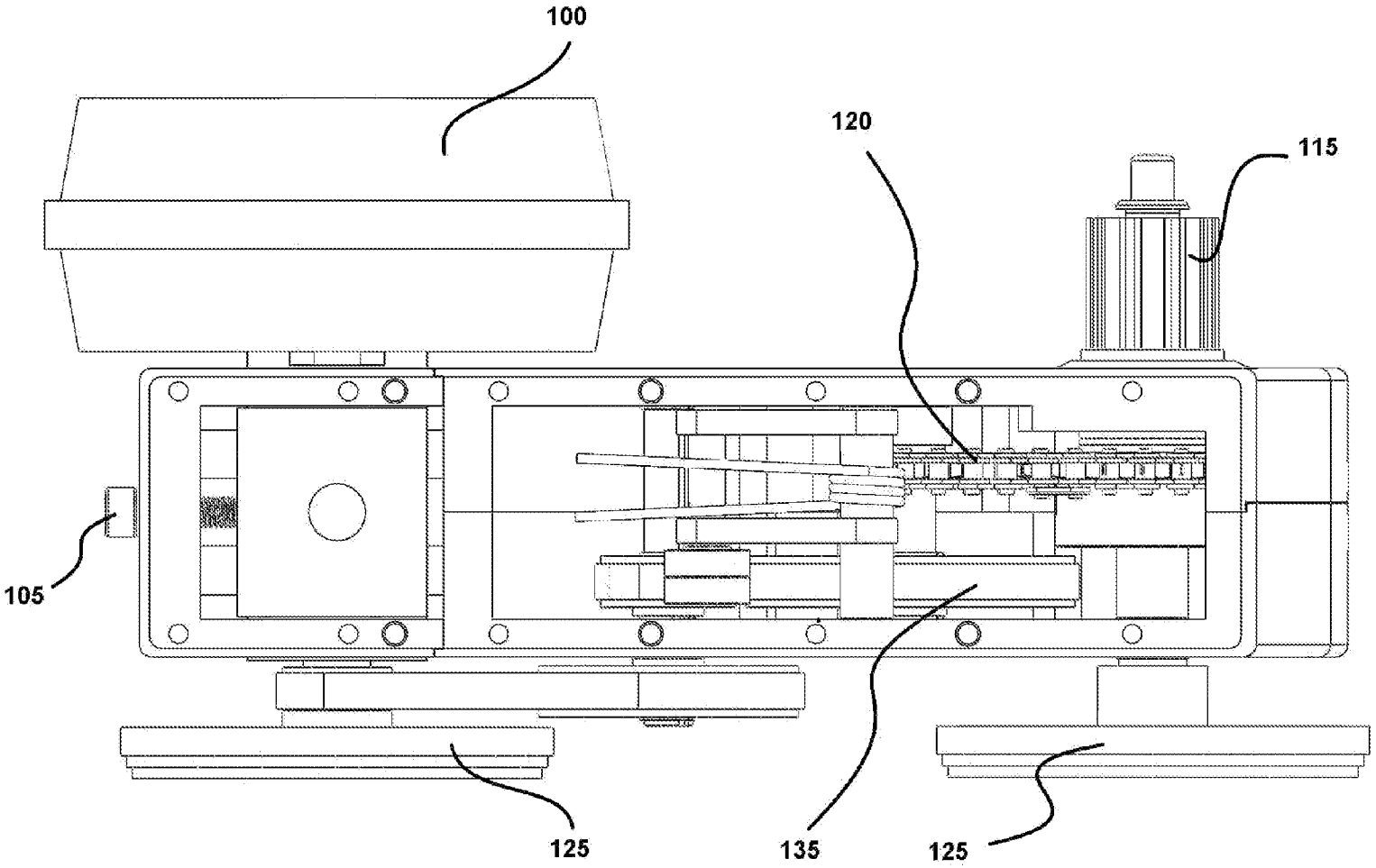
FIG. 3 displays a cutaway view of the transmission of the preferred embodiment of the present invention from the bottom.

A primary component of the present invention is the unique transmission (50) that is found as a replacement to the conventional bicycle tire found on conventional sizing fit cycles. The transmission (50) is held within a sophisticated transmission housing (80) which helps to ensure that the amount of noise and vibration is kept to a minimum. Elements of the transmission (50) may be seen up close in FIG. 2. The transmission (50) of the present invention was designed to be light weight, compact, slip free, quiet, and simulate the resistance traditionally provided by a real tire. The design of the transmission (50) is compact, such that the center distances found between the internal pulleys and sprockets are found extremely close together. Their high proximity requires the use of smaller diameter pulleys and sprockets than a conventional sprocket assembly. In order to combat belt slipping, the present invention preferably employs a one chain speedup and two micro rib v-belts to transmit power from the rear hub to the load generator (100) within the transmission (50). It has been found that the connection to the primary sprocket (70) should preferably be established via a chain (120) so that we can transmit the power without belt slippage. This chain (120) and v-belt setup keeps the noise to a minimum. The present invention employs a second speedup via a v-belt, which is enabled by increasing the conventional pulley sizes, dropping the overall gear ratios of a conventional transmission, and adding a self adjusting tensioning system. The final speedup is made using another micro rib v-belt with another, second form of tensioning system. The transmission (50) of the present invention preferably has two flywheels (125). The flywheels (125) are designed to add to the simulation and provide the 'feeling' of actual riding or the experience of a bike tire. The rear flywheel is incorporated into the transmission (50) in order to keep the same amount of inertia required for the load generator (100) to function correctly, and to "push" the system along to maintain its true bike feel. The flywheels (125) exist to help "pull" the system along, providing the known effect of 'coasting' on a bicycle. This results in much of the same rolling resistance and rolling inertia as an actual bike would. The transmission (50) helps to ensure that the rider is able to achieve an accurate simulated bicycle ride. The accuracy of the simulation is crucial so that the rider rides in approximately the same fashion that he or she would on the road, in order to mimic the distribution of the rider's weight as he or she pedals.

Another added benefit to the transmission (50) of the present invention is that it is highly standardized and therefore repeatable. The transmission (50) is much more consistent and repeatable than a conventional bicycle wheel setup, in that the gear system is directly attached to the load generator (100) within the transmission (50), rather than externally via the common metal-on-rubber interaction of other sizing fit cycles that employ a full-sized tire. This transmission engages the resistance device (100) directly, instead of using a tire with more variables such as air pressure to overcome. The gearing of the present invention is consistent. A bike tire has to have the exact pressure every time to be repeatable, whereas the present invention does not require a tire at all, so the variable is eliminated. In other sizing bicycles, the tire must maintain the same pressure on the roller within the load generator (100), otherwise too much or too little pressure results in an effectively smaller circumference and inaccurate speed measurement.

It can be envisioned that, in alternate embodiments of the present invention, all of the conventional speedup jumps of the transmission (50) are to be driven by micro rib v-belts (45). These micro rib v-belts (45), employed by the ribbed-belt drive (135) of the present invention, are preferably made of rubber. This instantiates the quietest form of the present invention, as no chain noise or air pockets within the transmission exist to create vibrations when in use.

It is the intent of the present invention to function in conjunction with the natural stride of an individual's bicycle pedaling. For example, as an individual pedals, the individual shifts his or her body weight in order to retain balance and achieve a 'flow.' This is similar to walking, when an individual may shift their body weight or extent their limbs, altering their gait and controlling their speed to maintain an even flow. This is performed by the brain subconsciously. It is the intent of the present invention to monitor the balance and shift in applied force of an individual via a computer (85) while he or she rides on the sizing fit cycle. Adjustments are then made to ensure that the individual is attaining the most proportional and efficient stride in pedaling as possible while retaining maximum comfort. The appropriate sizing is output to the computer (85) manually, which, in turn may be sent to a printer or emailed to a shop for the correct sizing of a bicycle setup for the individual.

In alternate embodiments of the present invention, it is envisioned that the sizing fit cycle may accommodate several differing types of resistance devices. Each resistance device could be custom tailored to a particular customer's needs. Versatility such as this may enable an individual to employ a familiar and trusted resistance device. It is envisioned that if a customer or user is familiar with a certain device of resistance, then additional training is eliminated, facilitating use of the present invention by dramatically reducing the learning curve.

The present invention preferably employs two target levels on the base (10) of the sizing fit cycle, as well as preferably six separate adjustable leveling feet (55), all designed to ensure that the rapid leveling of the present invention is easy and quick to perform. Ensuring that the present invention is level yields adjustments and calibrations that are more precise, increasing the repeatability of the results.

It is envisioned that embodiments of the present invention may include an adjustment knob (105) located on the outside of the transmission casing (80), preferably near the rear. This adjustment knob (105) is preferably designed to vary the tension of the belts held within the transmission, such that they remain taut and in proper position. It is also envisioned that the adjustment knob (105) be employed in the event that any transmission belt requires service or replacement.

It is to be understood that the present invention employs the use of a conventional seat, handlebars, and pedals, which are provided by the end user or buyer of the present invention and are not included in the invention. However, it is envisioned that elements such as these could be provided in future iterations of the present invention. Additionally, changing out the pedals, handlebars, and seats help provide a better fit for the unique rider.

Additionally, alternate embodiments of the present invention may be crafted to be used for rehabilitation. The present invention could also be employed as a spin cycle. Similarly, it is envisioned that the present invention may be used in a wind tunnel in order to attain an aerodynamic fit.

It should be understood that the present invention is a sizing fit cycle, comprising a base (10), a set of pedals (40) in communication with the base (10), a first lift, known as an elevated telescoping seat mount (25), attached to the base (10), a second lift, known as a telescoping handlebar mount (30), attached to the base (10), and a transmission (50) attached to the base (10). The present invention is configured to receive a computer (85). The computer (85) of the present invention is in communication with the transmission (50). The transmission (50) employs a ribbed-belt drive (135) that is preferably made of a rubber composite. The present invention also has a first lateral sliding mechanism, which allows said telescoping seat mount (25) to move horizontally along said horizontal rails (45), along the base (10), under the first lift. The present invention also has a second lateral sliding mechanism, which allows said telescoping handlebar mount (30) found under said second lift, mounted to the horizontal rails (145) on the base (10) to move horizontally. A calibrated measuring strip preferably extends between the first lift and the second lift, along the base (10), on the horizontal rails (145). The transmission (50) of the present invention has a load generator (100). The transmission (50) of the present invention is in communication with said computer (85).

We claim:

1. A sizing fit cycle, comprising:

two pedals;

a set of handlebars;

a seat;

a base configured to receive the set of handlebars, the two pedals, and the seat;

a first lift attached to the base, wherein the first lift is disposed under the seat;

a first lateral sliding mechanism disposed under the first lift;

a second lift attached to the base, wherein the second lift is disposed under the set of handlebars;

a second lateral sliding mechanism disposed under the second lift;

wherein the base is in communication with the first lift and the second lift;

at least one leveling screw;

a transmission equipped with multiple gears, pulleys and sprockets within a gearbox, the transmission further comprising a load generator in communication with a computer;

at least one flywheel in communication with the base and the transmission;

and a calibrated measuring strip extending between the first lateral sliding mechanism and the second lateral sliding mechanism along the base, wherein the first lateral sliding mechanism, the second lateral sliding mechanism, the first lift, and the second lift are configured to be adjusted while a user pedals the set of pedals in communication with the base.

2. The sizing fit cycle of claim 1, wherein the set of handlebars is equipped with a mount for a computer.

3. The sizing fit cycle of claim 1, wherein the transmission has at least one ribbed belt made of rubber composite.

4. The sizing fit cycle of claim 1, wherein the transmission is configured to replicate wheel inertia.

5. The sizing fit cycle of claim 3, further comprising: a chain, wherein the chain is housed within the transmission; a primary sprocket, wherein the primary sprocket is housed within the transmission; wherein the chain is in communication with the ribbed-belt via the primary sprocket; and wherein the at least one flywheel is configured to replicate the effect of coasting.

* * * * *